US006783125B2

(12) United States Patent
Shoji et al.

(10) Patent No.: US 6,783,125 B2
(45) Date of Patent: Aug. 31, 2004

(54) STAPLER PROCESSING APPARATUS FOR PAPER COLLATING MACHINE

(75) Inventors: Hideo Shoji, Ibaraki-ken (JP); Koji Higashi, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/446,090

(22) Filed: May 28, 2003

(65) Prior Publication Data

US 2003/0230840 A1 Dec. 18, 2003

(30) Foreign Application Priority Data

Jun. 18, 2002 (JP) ..... P2002-177219

(51) Int. Cl.[7] ..... B65H 37/04

(52) U.S. Cl. ..... 270/58.12; 270/58.16; 399/410; 271/221

(58) Field of Search ..... 270/58.08, 58.11, 270/58.12, 58.14, 58.16; 271/220, 221; 399/410

(56) References Cited

U.S. PATENT DOCUMENTS 4,073,391 A * 2/1978 O'Brien et al. ..... 414/789
4,511,297 A 4/1985 Wilson et al.
5,473,420 A * 12/1995 Rizzolo et al. ..... 399/107
5,478,062 A * 12/1995 Horiuchi et al. ..... 270/58.08
5,762,328 A 6/1998 Yamada et al.
6,145,825 A 11/2000 Kunihiro et al.
6,601,840 B2 * 8/2003 Boss et al. ..... 270/58.08
6,666,444 B1 * 12/2003 Paoli ..... 270/58.11

* cited by examiner

*Primary Examiner*—Patrick Mackey
(74) *Attorney, Agent, or Firm*—Nath & Associates PLLC; Gary M. Nath; Marvin C. Berkowitz

(57) ABSTRACT

A stapler processing apparatus includes a paper jogging tray 6 for a collated sheet 3, a paper jogging unit 7 for jogging the collated sheet 3 by pressing it on the tray 6 by a presser jogging member 13, a stapler 8 for stapling the collated sheet 3 jogged by the paper jogging unit 7 and a paper discharging unit 9 for discharging the collated sheet 3 stapled by the stapler 6 from the tray 6. In operation, when the stapler 8 staples the collated sheet 3, it is forced to the tray 6 while making an upper driven roller 30*b* in close contact with a lower drive roller 30*a*. After stapling by the stapler 8, the paper jogging operation of the paper jogging unit 7 is stopped and the upper driven roller 30*b* is separated from the lower drive roller 30*a* to release the collated sheet 3 from it nipped state once. Subsequently, the upper driven roller 30*b* is brought into close contact with the lower drive roller 30*a* again and the discharge operation is started.

5 Claims, 16 Drawing Sheets

FIG. 16

| | ACTION BEFORE DISCHARGE | |
|---|---|---|
| | NO RELEASING OF NIP | RELEASING OF NIP |
| OCCURRENCE FREQUENCY OF PAPER JAM | 11% | 0% |

STAPLER PROCESSING APPARATUS FOR PAPER COLLATING MACHINE

BACKGROUND OF THE INVENTION

1. Field of the Invention

The present invention relates to a stapler processing apparatus which is suitable for a paper collating machine that staples a plurality of papers loaded into the machine and subsequently discharges the stapled papers.

2. Description of the Related Art

The present applicant of the invention has proposed a stapler processing apparatus loaded on a paper collating machine before (Japanese Patent Application No. 2002-38756). As shown in FIG. 1, this stapler processing apparatus 100 includes a paper jogging tray 102 into which a collated sheet (consisting of plural papers stacked up) 101 is loaded from the transfer-downstream side of a collating body and which is inclined so as to lower its transfer-downstream side to the transfer-upstream side, a paper jogging unit 107 that allows a presser jogging member 106 to urge the collated sheet 101 to a paper-tip reference wall 104 at the lowermost position of the paper jogging tray 102 and a paper-side reference wall 105 on the lateral side of the tray 102, a stapler 108 for stapling the collated sheet 101 jogged by the paper jogging unit 107 and a paper discharging unit 111 that nips the collated sheet 101 stapled by the stapler 108 between an upper roller 109 and a lower roller 110 thereby to discharge the collated sheet 101 from the top of the paper jogging tray 102 due to the action of a transporting force by the rotations of the upper and lower rollers 109, 110 on the collated sheet 101.

The operation of the above stapler processing apparatus 100 will be described with reference to an operational flow chart of FIG. 2. First, the collated sheet 101 collated by the collating body is loaded to the paper jogging tray 102 in a loading direction IN (step S100). Then, the presser jogging member 106 moves from its stand-by position (a solid line of FIG. 1) to the jogging position (an imaginary line of FIG. 1) to urge the end face of the collated sheet 101 against the paper-side reference wall 105, thereby jogging the papers (step S101). This so-jogged collated sheet 101 is stapled by the stapler 108 (step S102). After stapling, the presser jogging member 106 returns the stand-by position and the upper roller 109 moves to the contact position to nip the collated sheet 101 between the upper roller 109 and the lower roller 110. Then, the upper roller 109 and the lower roller 110 are rotated. The rotations of the rollers 109, 110 allow a feeding force to act on the collated sheet 101, so that it is discharged in an unloading direction OUT (step S103).

Meanwhile, the paper jogging unit 107 can jog the papers by displacing the presser jogging member 106 from the stand-by position to the jogging position, the jogging position is established in accordance with a specific standard size for the papers forming the collated sheet 101. Thus, at the jogging position, an appropriate jogging is carried out by pinching the lateral end faces on both sides of the collated sheet 101 between the paper-side reference wall 105 and the presser jogging member 106.

However, it is noted that there may exist a collated sheet 101 of which size is somewhat larger than the standard size established for the collated sheet 101. If papers exceeding the standard size are jogged by the presser jogging member 106, the paper jogging unit 107 will jog the collated sheet 101 while its intermediate portion is being bent upward, as shown in FIG. 3. When the so-bent collated sheet 101 is stapled by the stapler 108, the resultant staple position of the sheet 101 may be deviated from the formal staple position of the collated sheet 101 having no bending.

In order to suppress the above bending of the collated sheet 101, as shown in FIG. 4, it may be expected to make the upper roller 109 press down the so-bent collated sheet 101 and thereupon, the stapler 108 staples the collated sheet 101 whose bending has been eliminated. However, at a point of time of discharging the collated sheet 101 by the upper roller 109 and the lower roller 110, the feeding operation of the collated sheet 101 becomes unstable since it is easy to be fed obliquely, thereby being at the root of paper jam.

SUMMARY OF THE INVENTION

Under such a circumstance, it is therefore an object of the present invention to provide a stapler processing apparatus that can stabilize both of the stapling position of papers to be collated and the feeding operation in discharging the papers even if the size of the papers is somewhat larger than the standard size.

In the first aspect of the present invention, a stapler processing apparatus comprises: a paper jogging tray into which a plurality of papers are to be loaded; paper jogging means for jogging the papers by forcing respective end faces of the papers to a reference wall of the paper jogging tray; a stapler for stapling the papers jogged by the paper jogging means; paper pressing means for nipping the papers stapled by the stapler; paper discharging means for discharging the papers from the paper jogging tray by acting a transfer force due to the rotations of an upper and lower rollers on the papers; and control means for controlling the operations of the paper jogging means, the stapler, the paper pressing means and the paper discharging means in such a manner that at stapling the papers by the stapler, the control means makes the paper pressing means in close contact with the paper jogging tray thereby pressing the stapled papers to the paper jogging tray, after completing the stapling operation of the stapler, the control means makes the paper jogging means to stop a paper jogging operation thereof and the paper pressing means to separate from the paper jogging tray thereby once releasing the papers from the paper pressing means and subsequently, the control means makes the paper pressing means in close contact with the paper jogging tray and also makes the paper discharging means start discharging the stapled papers.

In the stapler processing apparatus constructed above, if the size of the papers is somewhat larger than the standard size, the paper jogging means will jog the papers in the deflected condition where the intermediate portion of the papers is raised. However, the deflection of the papers is suppressed by the paper pressing means pressing them down. Then, the stapler staples the papers while the deflection is being suppressed. After the stapling operation of the stapler, the paper jogging means is released from pressing the papers and further, the paper pressing means is also released from pressing the papers to the paper jogging tray. As a result, the deflection of the papers is canceled and the discharging operation of the papers is carried out while any deflection is being removed therefrom.

In the second aspect of the present invention, another stapler processing apparatus comprises: a paper jogging tray into which a plurality of papers are to be loaded; paper jogging means for jogging the papers by forcing respective end faces of the papers to a reference wall of the paper jogging tray; a stapler for stapling the papers jogged by the paper jogging means; a pair of upper and lower rollers for nipping the papers stapled by the stapler therebetween; paper discharging means for discharging the stapled papers from the paper jogging tray by acting a transfer force due to the rotations of the upper and lower rollers on the papers; and control means for controlling the operations of the paper jogging means, the stapler, the upper and lower rollers and the paper discharging means in such a manner that at stapling the papers by the stapler, the control means makes the upper roller in close contact with the lower roller thereby pressing the stapled papers to the paper jogging tray; after completing the stapling operation of the stapler, the control means makes the paper jogging means to stop a paper jogging operation thereof and the upper roller to separate from the lower roller thereby once releasing the papers from the upper and lower rollers; and subsequently, the control means makes the upper roller in close contact with the lower roller and also makes the paper discharging means start discharging the stapled papers.

In the above stapler processing apparatus, if the size of papers is somewhat larger than the standard size, the paper jogging means will jog the papers in the deflected condition where the intermediate portion of the papers is raised. However, the deflection of the papers is suppressed by the upper roller pressing them down. Then, the stapler staples the papers while the deflection is being suppressed. After the stapling operation of the stapler, the paper jogging means is released from pressing the papers and further, the upper roller is also released from pressing the papers to the paper jogging tray. As a result, the deflection of the papers is canceled and the discharging operation of the papers is carried out while any deflection is being removed therefrom.

In common with the above-mentioned stapler processing apparatuses, after the stapling operation of the stapler, a period of releasing the papers from being nipped may be adjustable.

It is noted that a time required to cancel the deflection of papers depends on the character of the papers. Therefore, if the period of releasing is changeable corresponding to the character of the papers, then it becomes possible to transfer the papers as fast as possible while maintaining the stability in transferring the papers.

These and other sheets and features of the present invention will become more fully apparent from the following description and appended claims taken in conjunction with the accompany drawings.

BRIEF DESCRIPTION OF THE DRAWINGS

FIG. 16 is a diagram explaining the frequencies of paper jam in both cases that a pre-discharging operation has been carried out and not carried out.

DETAILED DESCRIPTION OF THE PREFERRED EMBODIMENT

Hereinafter, embodiments of the present invention will be described with reference to the drawings.

FIGS. 5 to 16 show embodiments where a stapler processing apparatus of the present invention is installed in a paper collating machine.

Figure 1:
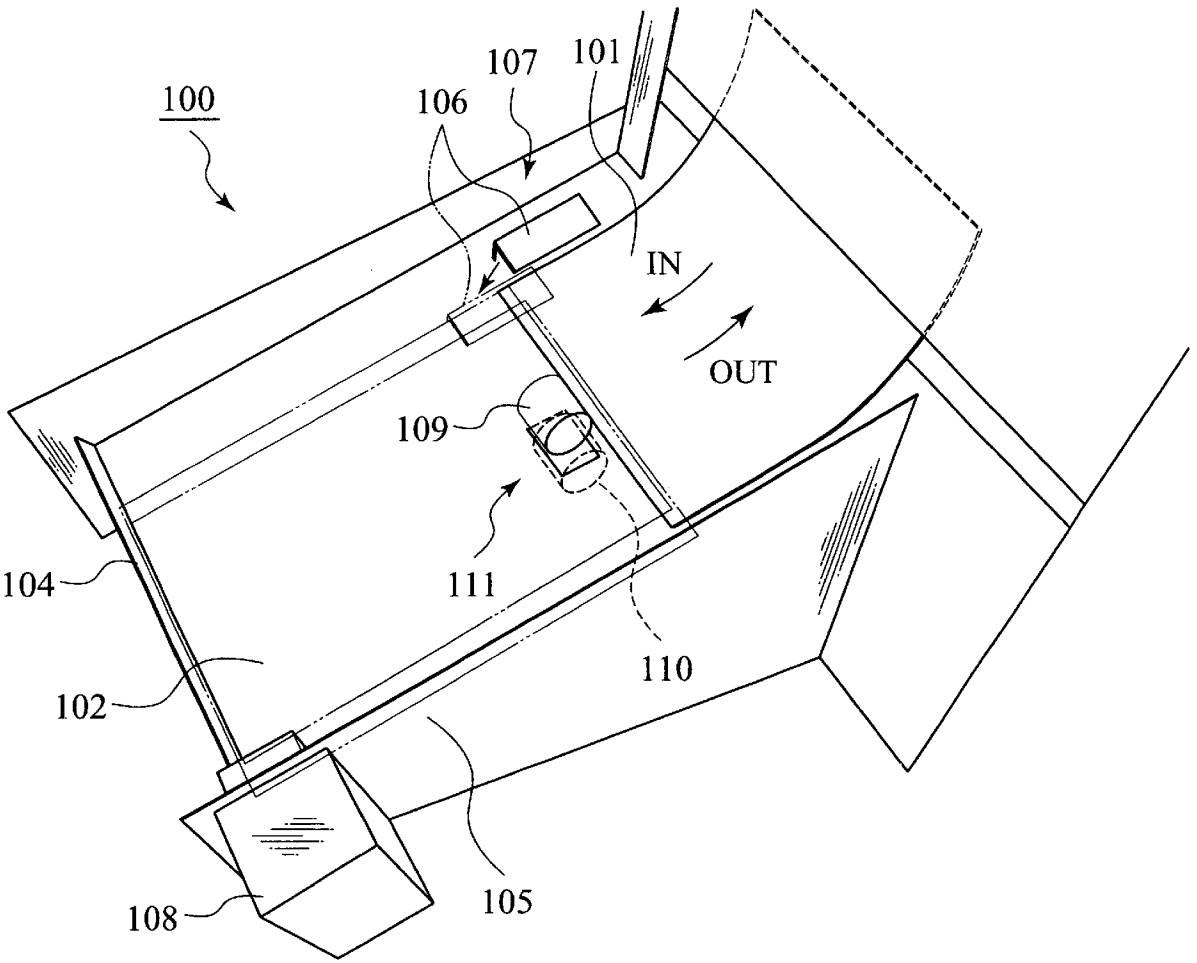
FIG. 1 is a perspective view of the conventional stapler processing apparatus.
Figure 2:
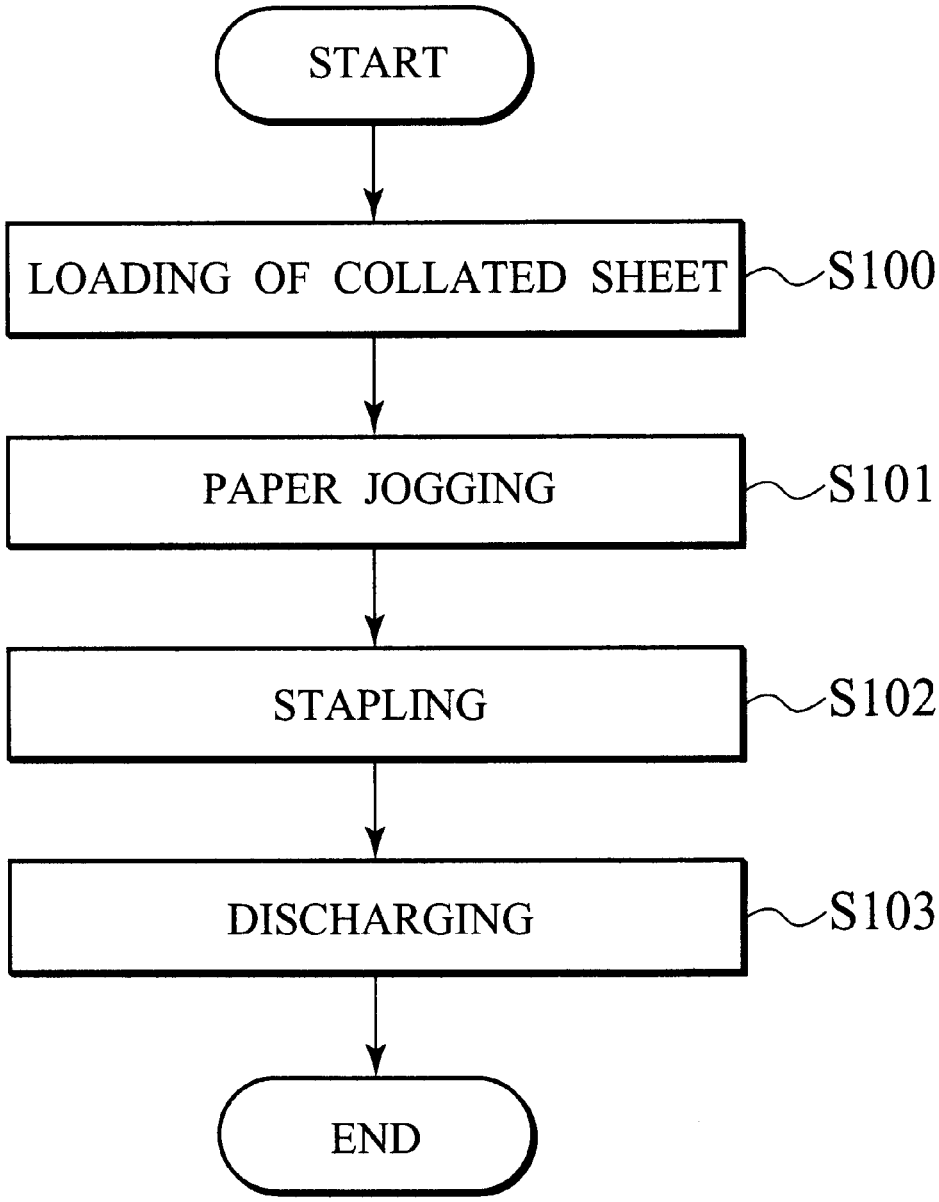
FIG. 2 is a flow chart of the stapling operation carried out by the conventional stapler processing apparatus.
Figure 3:
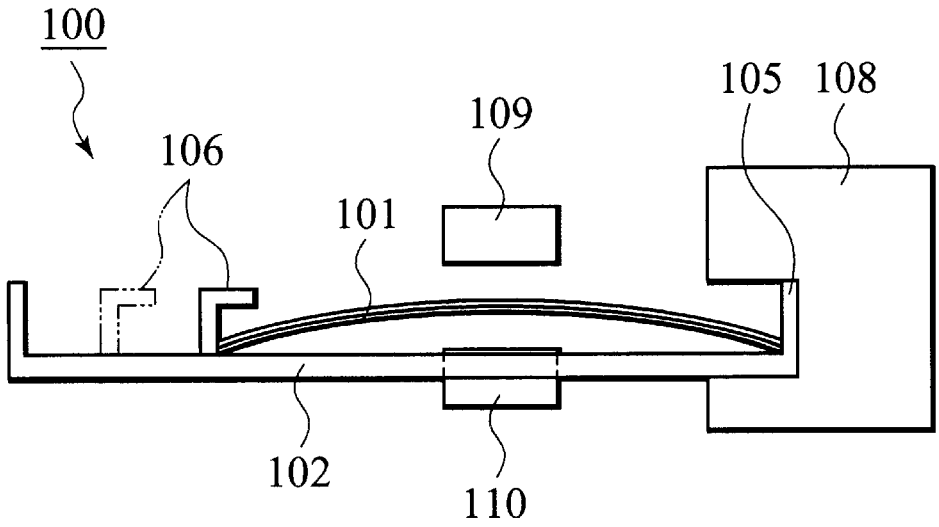
FIG. 3 is an explanatory view showing the bending condition of a collated sheet at its jogging, the collated sheet having its paper size somewhat larger than the standard size.
Figure 4:
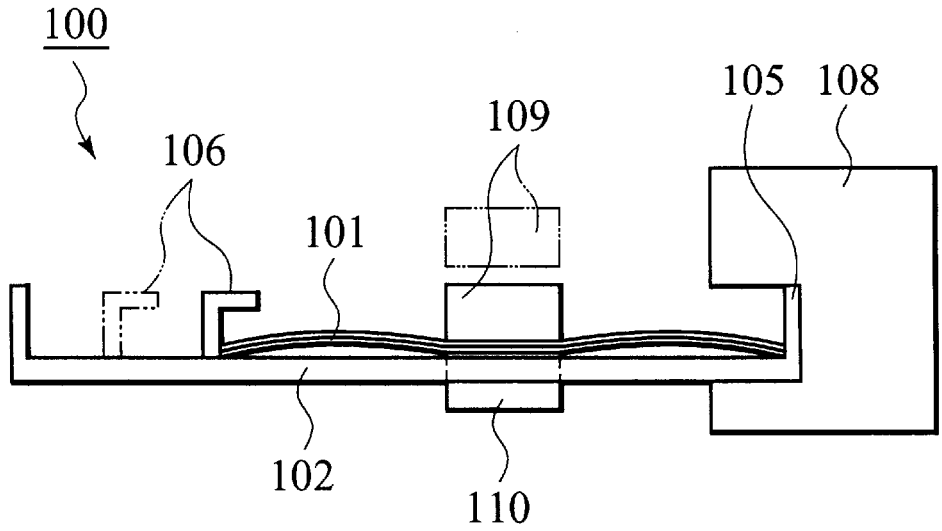
FIG. 4 is an explanatory view showing the bending condition of a collated sheet at its discharging, the collated sheet having its paper size somewhat larger than the standard size.
Figure 5:
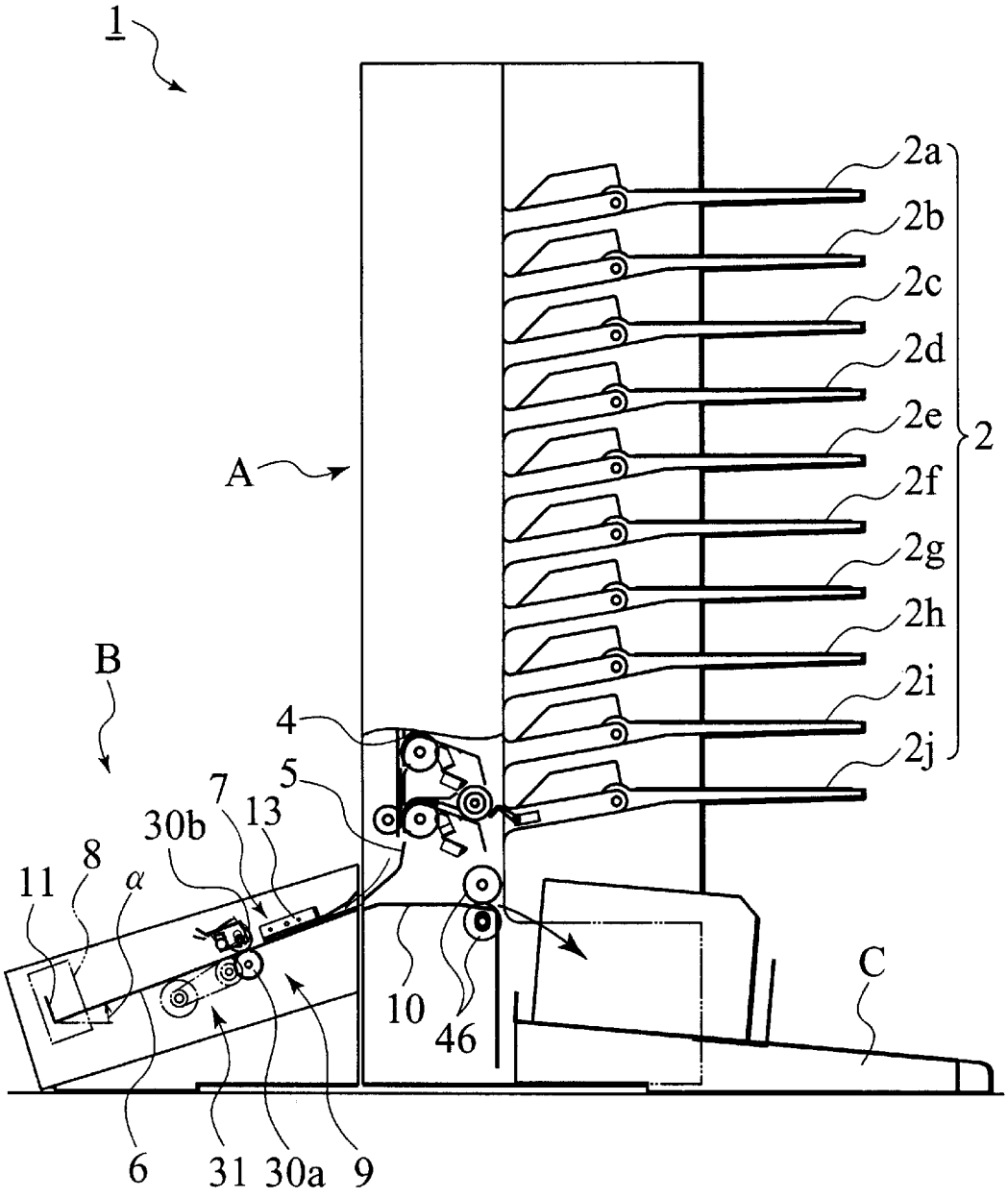
FIG. 5 is a partially-breaking side view of a paper collating machine in accordance with an embodiment of the present invention.

As shown in FIG. 5, a paper collating machine 1 is formed by a collating body A, a stapler processing part (i.e. a stapler processing apparatus of the invention) B arranged behind the collating body A and on its lower side, and a sheet discharging tray C arranged in front of the collating body A and on the lower side.

The collating body A includes a paper feed part 2 and a collating transfer part 4. The paper feed part 2 is equipped with a plurality of paper feed trays 2*a* to 2*j* in vertical arrangement and adapted so as to feed numerous papers (not shown) piled up in each tray 2*a* to 2*j*, one by one at a predetermined timing. The collating transfer part 4 transfers the plural papers fed from the paper feeding part 2 vertically and collates them to form a collated sheet 3. The collated sheet 3 transferred by the collating transfer part 4 is discharged to the stapler processing part B through a first transfer path 5.

Figure 6:
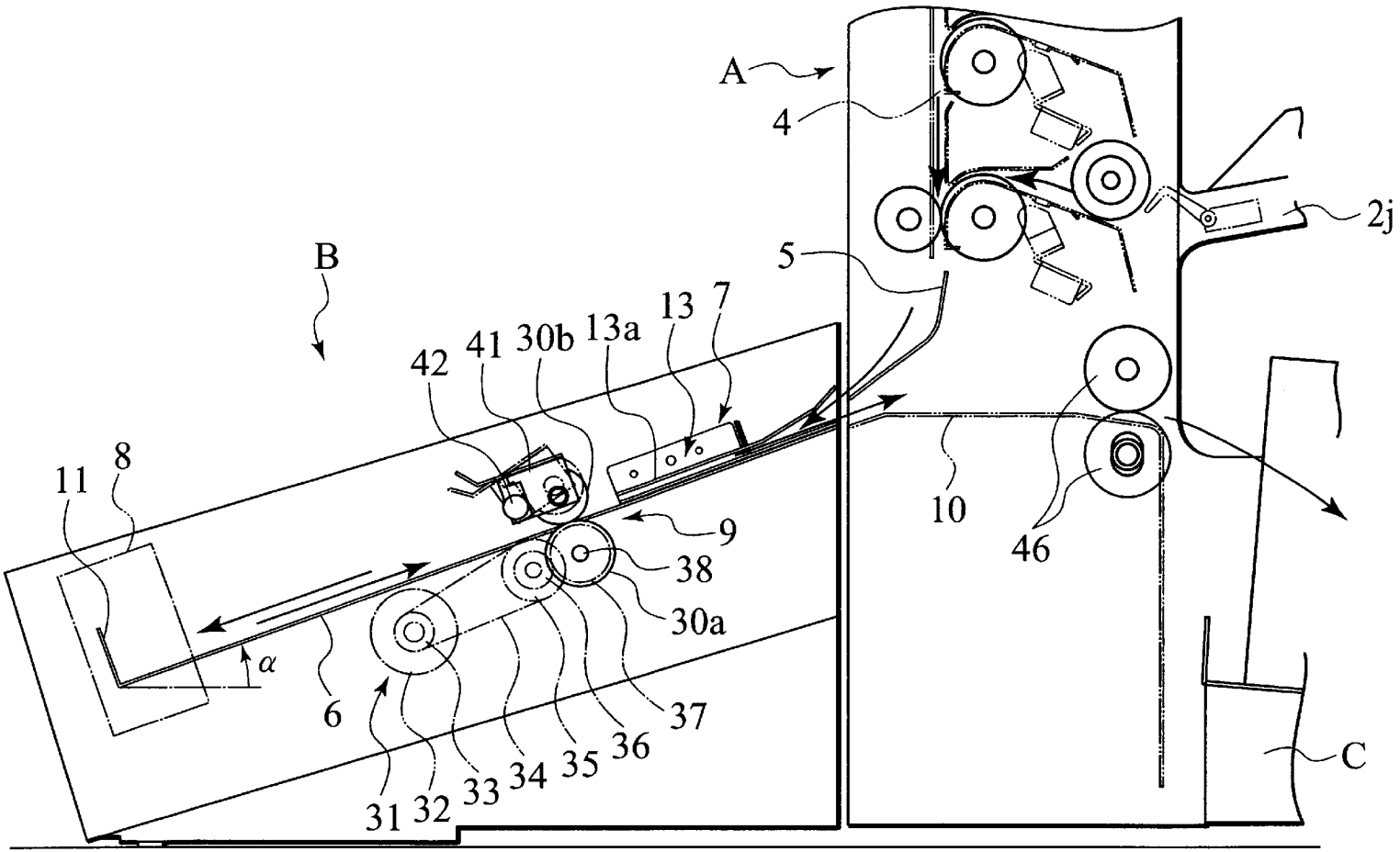
FIG. 6 is an enlarged view of an essential part of FIG. 5, showing the embodiment of the present invention.

In FIG. 6, the stapler processing part B includes a paper jogging tray 6 arranged on the downstream side of the first transfer path 5 and inclined to the horizontal direction, a paper jogging unit (paper jogging unit) 7 for jogging the collated sheet 3 on the paper jogging tray 6, a stapler 8 for stapling the collated sheet 3 jogged by the paper jogging unit 7 and a collated-sheet discharging unit (paper discharging means) 9 that exerts a discharging force in opposition to a loading direction to the collated sheet 3 stapled by the stapler 8. With the arrangement, the stapler processing part B discharges the collated sheet 3, which has been unloaded by the collated-sheet discharging unit 9, through a second transfer path 10 connected to the upstream side of the paper jogging tray 6.

The paper jogging tray 6 is inclined to the horizontal direction so that its downstream portion is below the upstream portion. Preferably, its inclination angle $\alpha$ ranges from 10 degrees to 30 degrees. In this embodiment, the inclination angle $\alpha$ is set to about 20 degrees.

Figure 7:
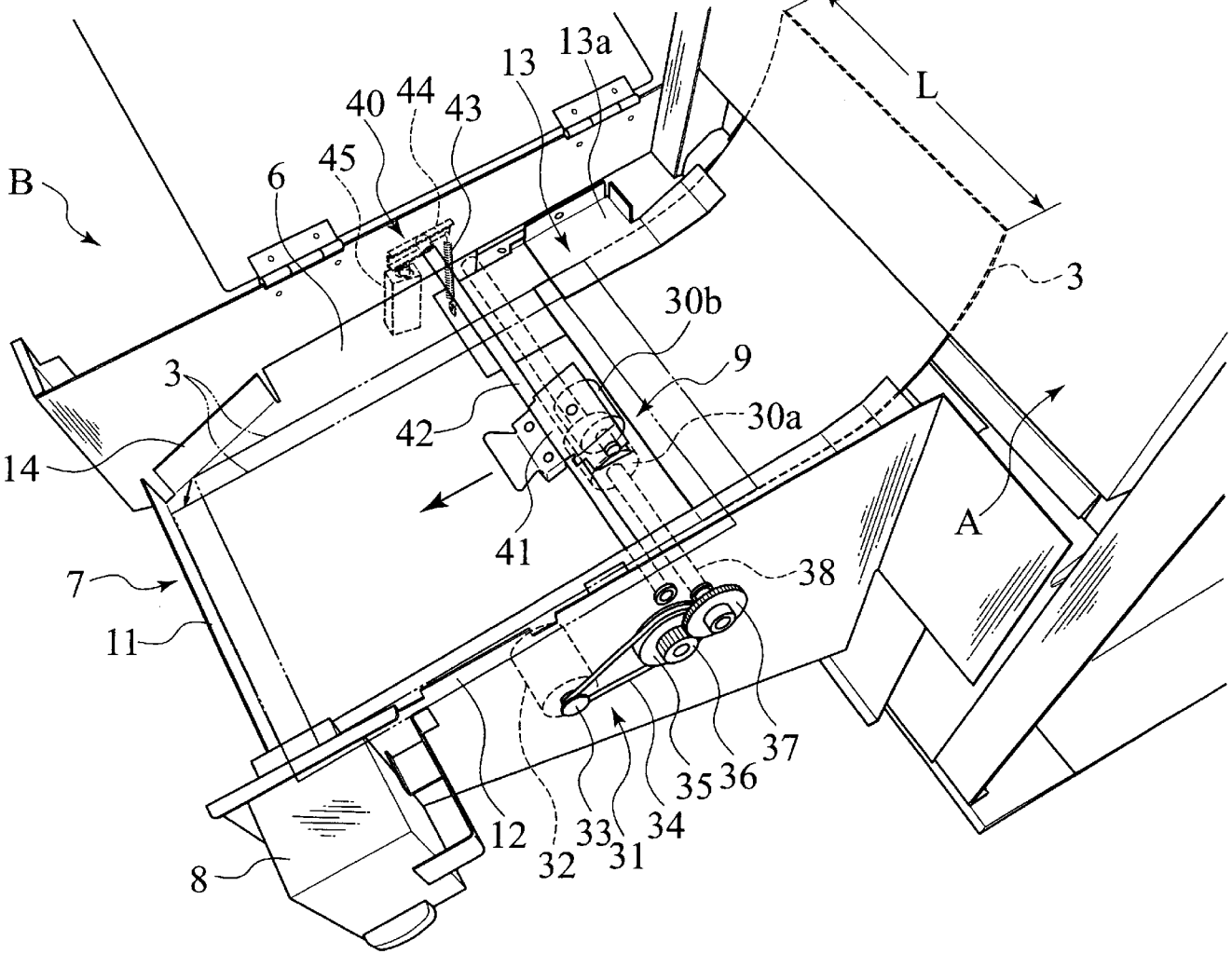
FIG. 7 is a perspective view of a stapler processing part of the paper collating machine in accordance with the embodiment of the present invention, showing a state where a collated sheet is being loaded.
Figure 8:
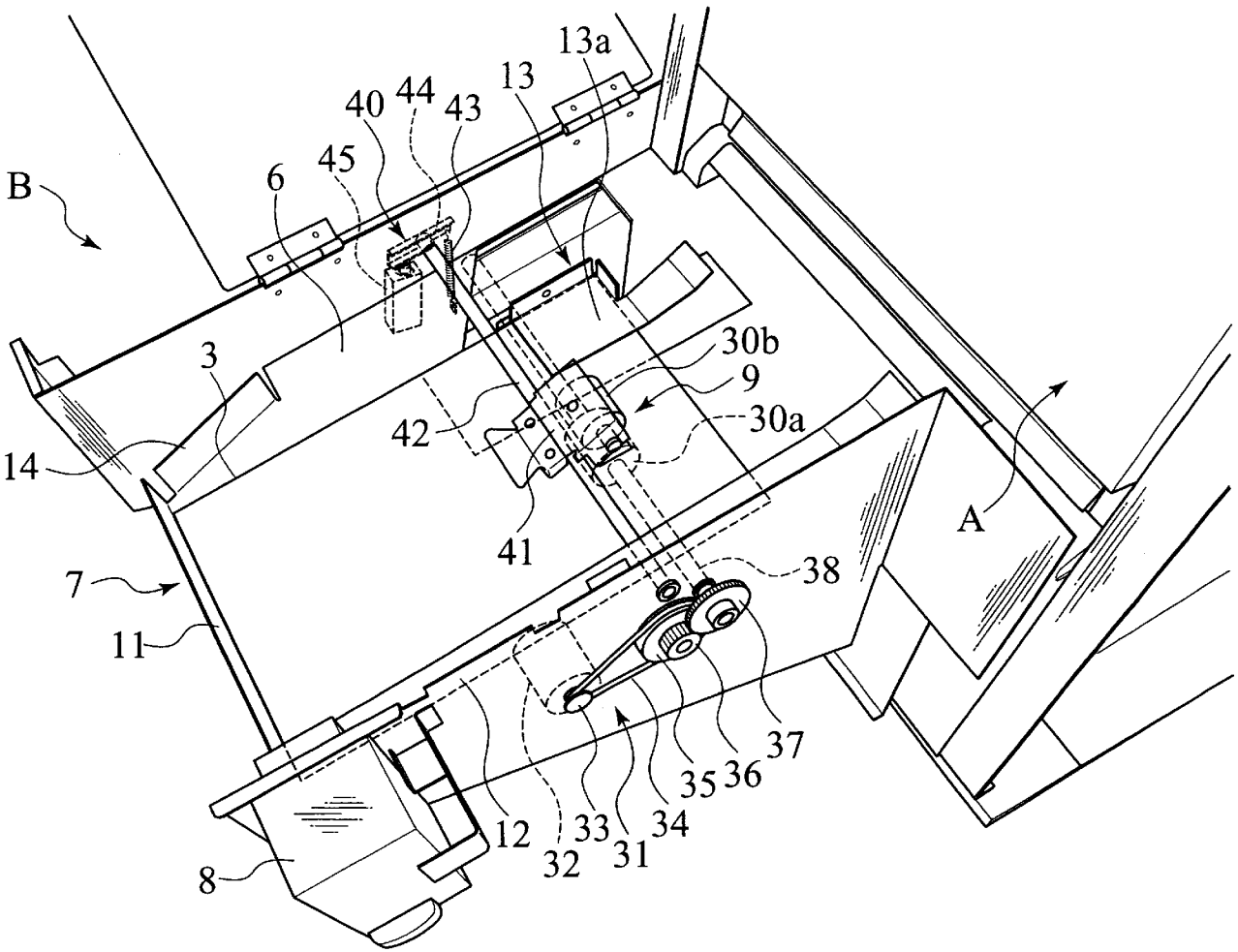
FIG. 8 is a perspective view of the stapler processing part of the paper collating machine in accordance with the embodiment of the present invention, showing a state where the collated sheet is jogged.
Figure 9:
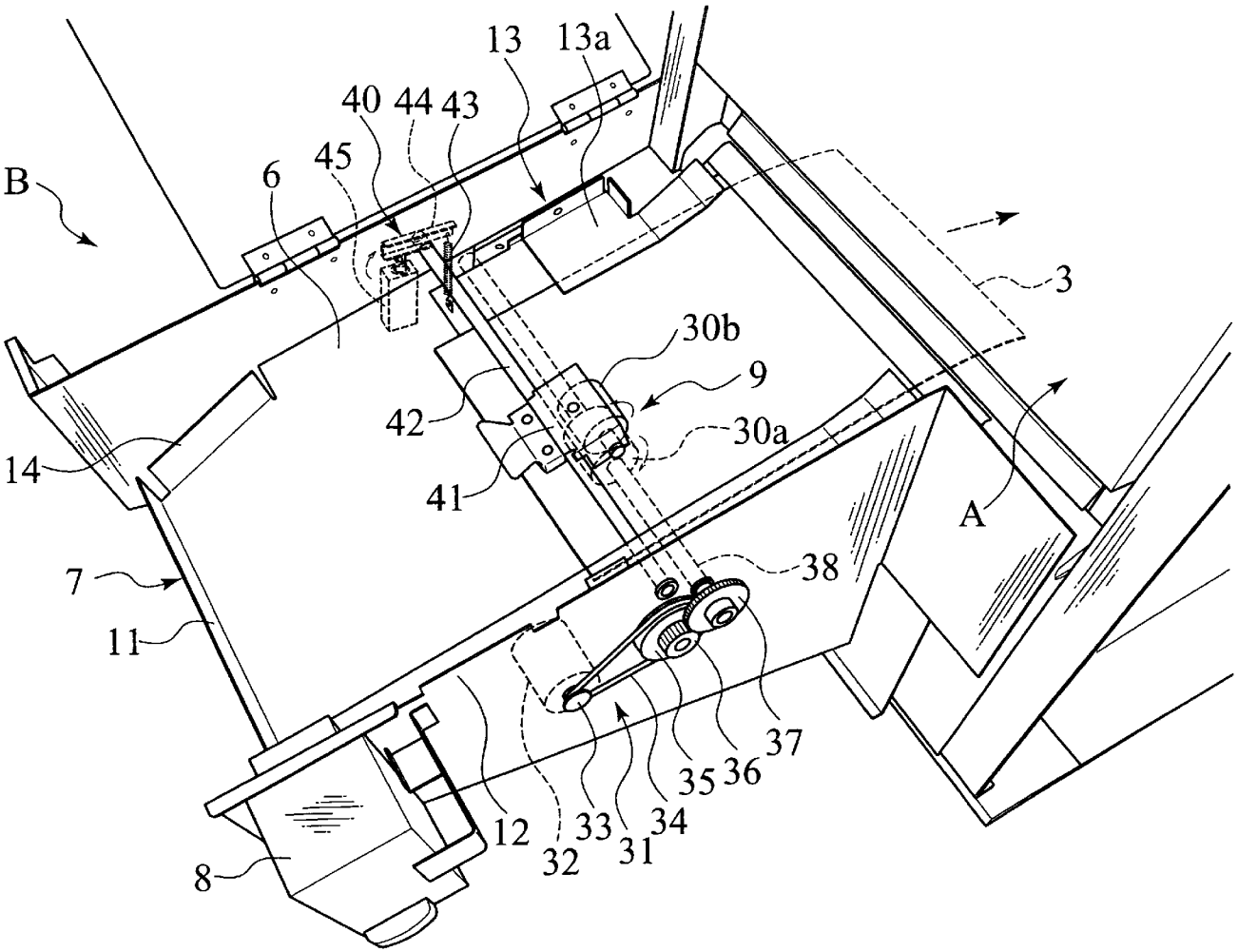
FIG. 9 is a perspective view of the stapler processing part of the paper collating machine in accordance with the embodiment of the present invention, showing a state where the collated sheet is being discharged.

In FIGS. 7 to 9, the paper jogging unit 7 has a paper-tip reference wall 11 arranged at the lowermost position of the inclined paper jogging tray 6, for contact with the tip of the collated sheet 3, a paper-side reference wall 12 perpendicular to the paper-tip reference wall 11, for contact with the lateral end face of the collated sheet 3, a presser jogging member 13 for pressing the collated sheet 3 to the paper-side reference wall 12, and a slanted sidewall 14 arranged sideways on the opposite side of the paper-side reference wall 12 and inclined so as to gradually approach the paper-side reference wall 12 as making toward the lower part of the paper jogging tray 6.

The presser jogging member 13 is adapted so as to press only the side face of the collated sheet 3 and also moved by a paper jogging mechanism 15 in an oblique direction facing an intersection of the paper-side reference wall 12 with the paper-tip reference wall 11. Further, the presser jogging member 13 has an upper face part 13*a* below which the rear end part of the collated sheet 3 loaded to the paper jogging tray 6 is to be positioned.

Figure 10:
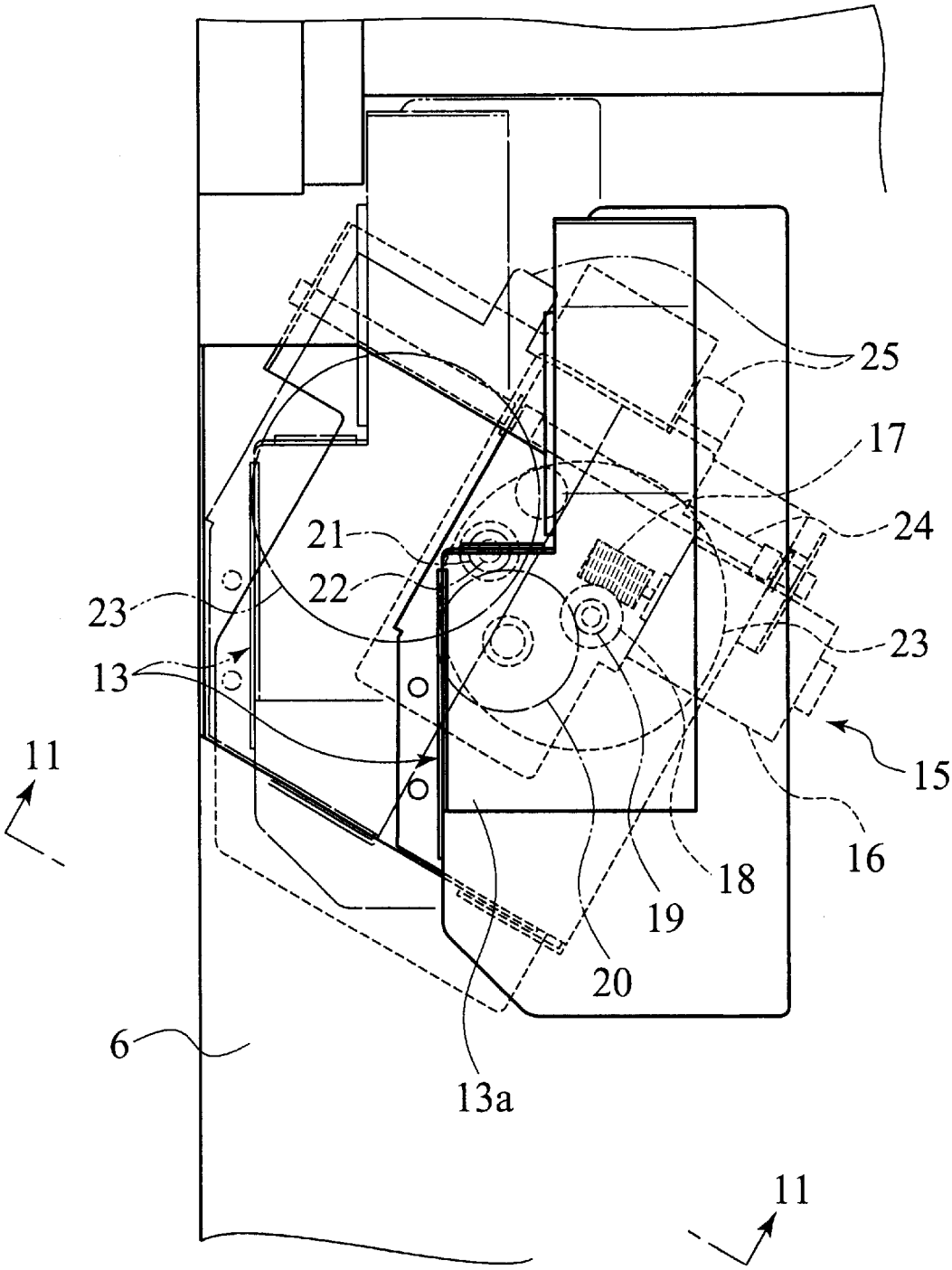
FIG. 10 is a plan view of a paper jogging mechanism of a paper jogging unit, showing the embodiment of the present invention.
Figure 11:
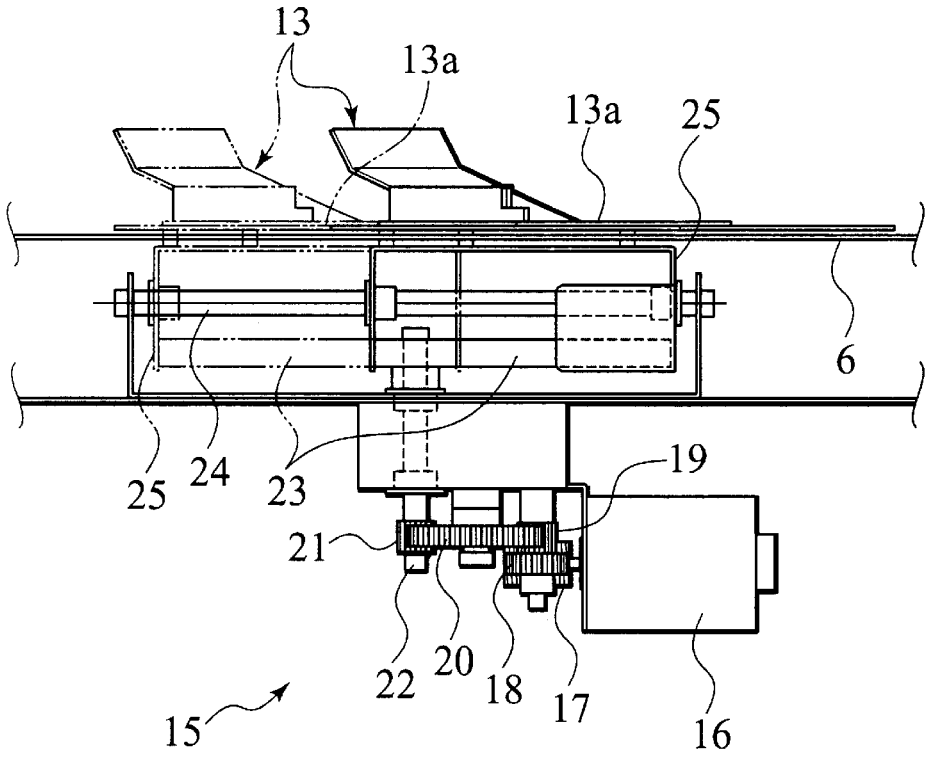
FIG. 11 is a sectional view taken along a line 11—11 of FIG. 10, showing the embodiment of the present invention.

As shown in FIGS. 10 and 11, the paper jogging mechanism 15 includes a paper jogging motor 16, a worm gear 17 fixed to a rotating shaft of the paper jogging motor 16, a worm wheel 18 meshing with the worm gear 17, a first flat gear 19 fixed to the worm wheel 18 coaxially, a second flat gear 20 meshing with the first flat gear 19, a third flat gear 21 meshing with the second flat gear 20, an eccentric cam disk 23 fixed to a fixing shaft 22 of the second flat gear 21 and a cam transmitting member 25 transferred along a guide rod 24. The presser jogging member 13 is fixed to the cam transmitting member 25, on the upper-face side of the paper jogging tray 6. The presser jogging member 13 is moved between the stand-by position shown with imaginary lines of FIGS. 10 and 11 and the paper-jogging position shown with solid lines of FIGS. 10 and 11. If the paper jogging position and the stand-by position are appropriately changeable dependently on the paper side of the collated sheet 3, then their positions can cope with a change in the paper size of the collated sheet 3. In detail, the paper jogging position is established in a position where an interval between the paper-side reference wall 12 and the presser jogging member 13 coincides with a width L of the paper size of the collated sheet 3.

As shown in FIGS. 7 to 9, the stapler 8 is arranged outside the paper-side reference wall 12 of the paper jogging table 6 and also established to provide a stapling position inside the intersection of the paper-side reference wall 12 with the paper-tip reference wall 11.

As shown in FIGS. 6 to 9, the collated-sheet discharging unit 9 includes a lower drive roller (lower roller) 30*a* arranged so as to face on the upper face of the paper jogging tray 6 through an opening formed therein and an upper driven roller (upper roller) 30*b* arranged so as to oppose the lower drive roller 30*a* on its upside.

The lower driven roller 30*a* is rotated by a discharging mechanism 31. The discharging mechanism 31 includes a discharging motor 32, a first pulley 33 fixed to a shaft of the motor 32, a belt 34 having one side wound about the first pulley 33, a second pulley 35 that the other side of the belt 34 is wound about, a first gear 36 fixed to the second pulley 35 coaxially and a second gear 37 meshing with the first gear 36. The lower drive roller 30*a* is fixed to a support shaft 38 supporting the second gear 37, so that the arrangement of the discharge mechanism 31 enables the motor 32 to rotate the roller 30*a*.

The upper driven roller 30*b* is transferred between a close position (shown with a solid line of FIG. 6) where the roller 30*b* is brought into close contact with the lower drive roller 30*a* by a roller separating mechanism 40 and a spaced position (shown with an imaginary line of FIG. 6) where the roller 30*b* is apart from the lower drive roller 30*a*. The roller separating mechanism 40 comprises a pivot shaft 42 fixed to a roller supporting member 31 of the upper driven roller 30*b* and rotatably supported by the paper jogging tray 6, a swing member 44 having its end subjected to a spring force of a spring 43 and an electromagnetic plunger 45 connected to the other end of the swing member 44. When the electromagnetic plunger 45 is inactivated, the spring force of the spring 43 allows the upper driven roller 30*b* to be positioned to the close position (see a solid line of FIG. 6 and FIG. 9). On the other hand, when the electromagnetic plunger 45 is activated, the swing member 44 and the pivot shaft 42 rotate with a regular angle, whereby the upper driven roller 30*b* is brought into the spaced position (see an imaginary line of FIG. 6 and FIGS. 7 and 8).

Figure 12:
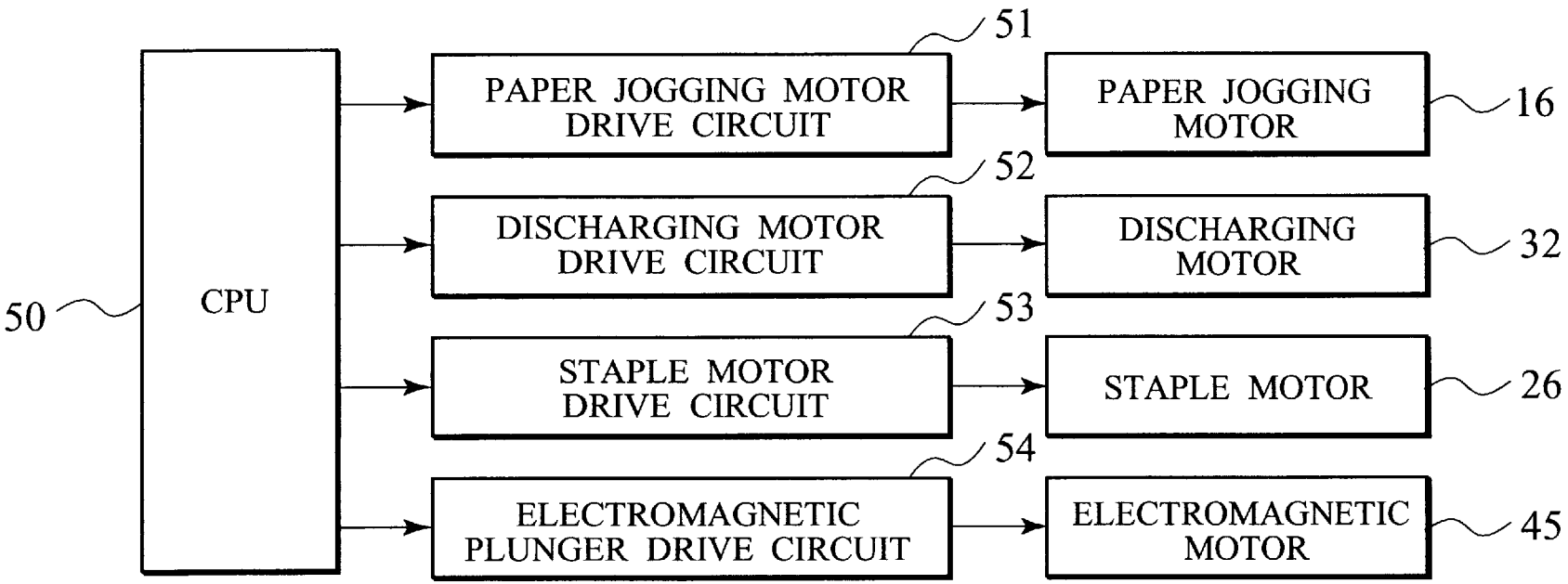
FIG. 12 is a circuit block diagram of the stapler processing part, showing the embodiment of the present invention.

The sheet discharging tray C is arranged on the same side as the paper feed trays 2*a* to 2*j* in relation with the collating body A and on the downstream side of the second transfer path 10. The sheet discharging tray C has a storage space capable of accommodating the collated sheet(s) 3 dropped from the second transfer path 10, in their stacked condition. On the discharging side of the second transfer path 10, there are provided a pair of discharging roller 46, 46 from which the collated sheet 3 is discharged into the sheet discharging tray C at a predetermined speed. Next, the control system of the stapler processing part B will be described. As shown in FIG. 12, a central processing unit (control means) 50 controls all operations of the paper jogging motor 16, the discharging motor 32, the staple motor 26 and the electromagnetic plunger 45 through a "paper jogging-motor" drive circuit 51, a "discharging motor" drive circuit 52, a "staple motor" drive circuit 53 and an "electromagnetic plunger" drive circuit 54, respectively.

Figure 13:
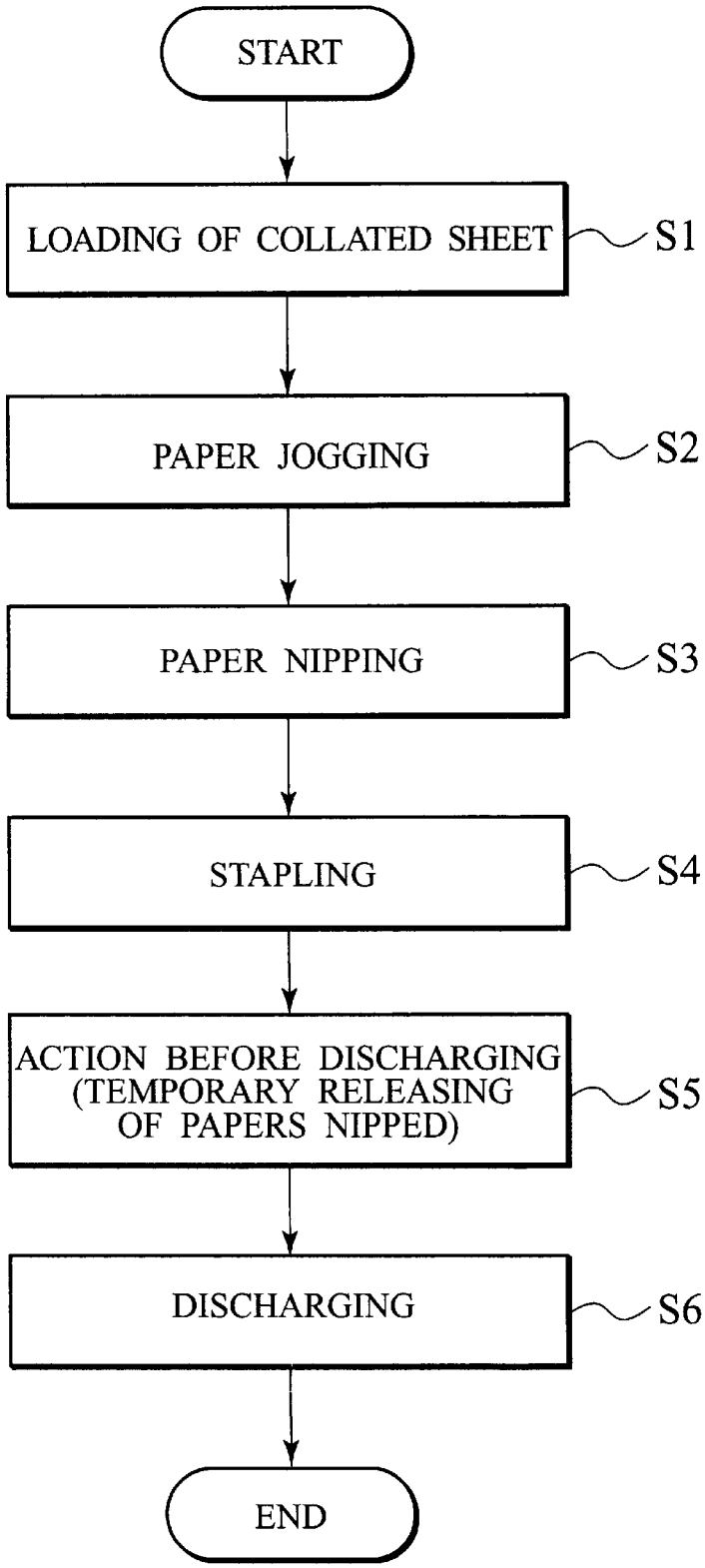
FIG. 13 is a flow chart of the operation of a stapler process, showing the embodiment of the present invention.
Figure 14:
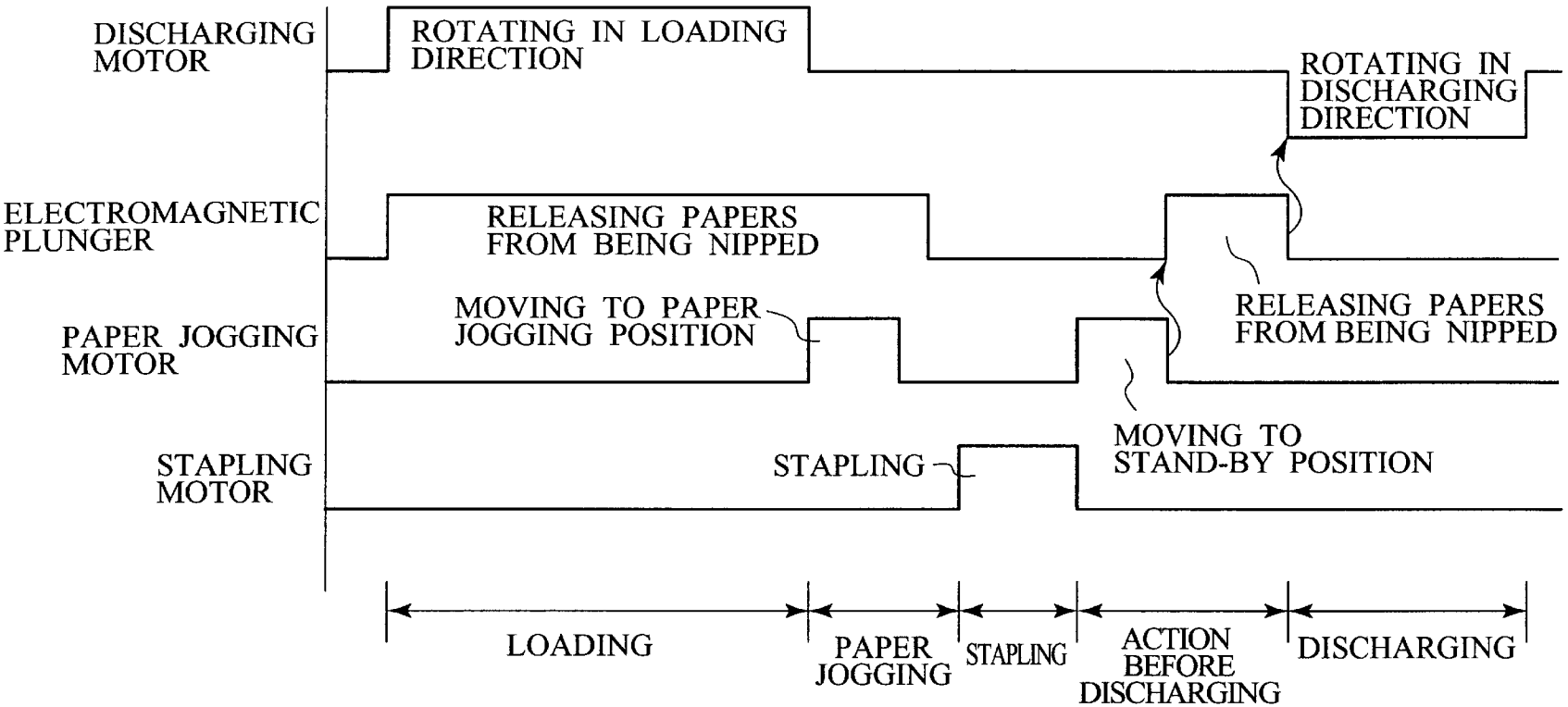
FIG. 14 is a timing chart of the operation of the stapler process, showing the embodiment of the present invention.

Based on FIGS. 13 and 14, the operation of the paper collating machine 1 will be described, mainly in the staple processing operation.

The presser jogging member 13 is arranged at the stand-by position. The upper driven roller 30*b* is positioned at the spaced position since the electromagnetic plunger 45 is turned on. While, the discharging motor 32 rotates in a loading direction, so that the lower drive roller 30*a* is rotated so as not to produce a loading resistance for the collated sheet 3. In this state, respective papers (not shown) on the paper feed trays 2*a* to 2*j* are supplied to the collating transfer part 4, one by one from the upper steps, with delays of a predetermined interval. The so-fed papers of various kinds are piled up at the collating transfer part 4 and collated into a collated sheet while being transferred. Then, as shown in FIG. 7, the resultant collated sheet 3 is loaded onto the paper jogging tray 6 through the first transfer path 5 (step S1). The collated sheet 3 slips on the paper jogging tray 6 downwardly. In this slipping process of the collated sheet 3, it is subjected, at its one end on the leading side, to an interference with the inclined sidewall 14 firstly. With this interference with the inclined sidewall 14, the collated sheet 3 slips downwardly while hopping toward the paper-side reference wall 12. Then, the slipping of the collated sheet 3 is stopped at a position where its leading end abuts against the paper-tip reference wall 11. In this state, the jogging for the collated sheet 3 is substantially completed in the loading direction.

On completion of the loading operation, the driving of the discharge motor 32 is stopped. Next, as shown in FIG. 8, the presser jogging member 13 is moved from the stand-by position to the paper-jogging position by the paper jogging mechanism 15, so that the collated sheet 3 is jogged along the paper-side reference wall 12 and the paper-tip reference wall 11 (step S2).

After the collated sheet 3 is jogged, the electromagnetic plunger 45 is switched to its inactivated (OFF) state to transfer the upper driven roller 30*b* from the spaced position to the close-contact position, so that the collated sheet 3 is nipped between the rollers 30*a*, 30*b* (step S3).

Next, the stapler 8 staples the collated sheet 3 (step S4). When stapled, the presser jogging member 13 is returned from the paper-jogging position to the stand-by position by the paper jogging mechanism 15, as shown in FIG. 9. Additionally, the electromagnetic plunger 45 is switched to its activated (ON) state to once transfer the upper driven roller 30*b* from the close-contact position to the spaced position, so that the collated sheet 3 is released from its nipped condition temporarily (step S5). Thereafter, the electromagnetic plunger 45 is switched to the inactivated (OFF) state again to transfer the upper driven roller 30*b* from the spaced position to the close-contact position.

Subsequently, the discharge motor 32 rotates in a discharging direction, so that a discharging force in the opposite direction to the loading direction is applied on the collated sheet 3 with the rotation of the lower drive roller 30*a* (step S6). Due to this discharging force, the collated sheet 3 is fed to the sheet discharging tray C via the second transfer path 10 and further laid on the tray C. By repeating the collating operation and the stapling operation, the sheet discharging tray C is stacked up with the collated sheets 3 stapled each.

Figure 15A:
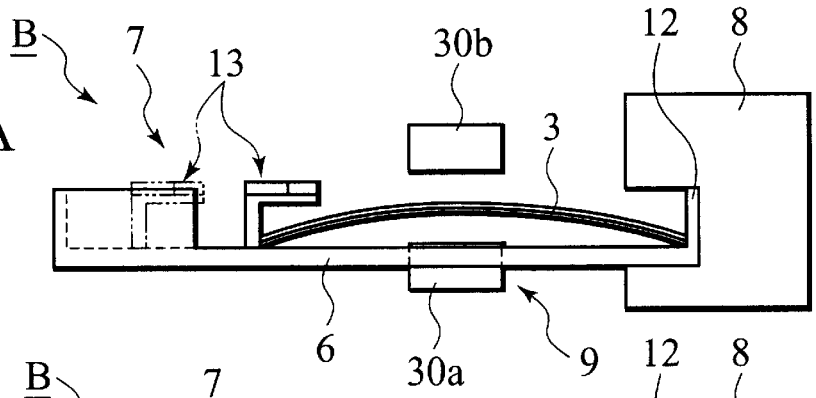
FIGS. 15A to 15D are respective views explaining sequential operations of the stapler process, showing the embodiment of the present invention.
Figure 15B:
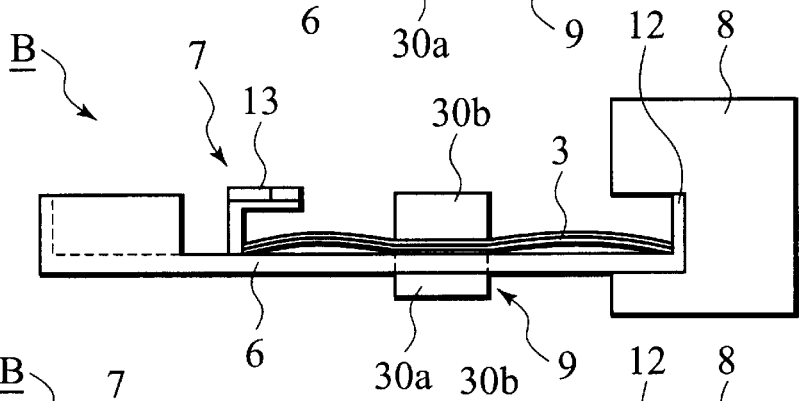

During the above operations, if the paper size of a collated sheet 3 is somewhat larger than the standard size, the paper jogging unit 7 will jog the collated sheet 3 in its deflected condition where the intermediate portion of the sheet 3 is raised, as shown in FIG. 15A. However, according to a sequent nipping operation, the deflection of the collated sheet 3 is suppressed by the upper driven roller 30*b* pressing it down, as shown in FIG. 15B. Then, the stapler 8 staples the collated sheet 3 while its deflection is being suppressed. Therefore, the stapling position of this collated sheet 3 is almost the same as the stapling position of a collated sheet 3 whose paper size is so standardized as to have no deflection.

Figure 15C:
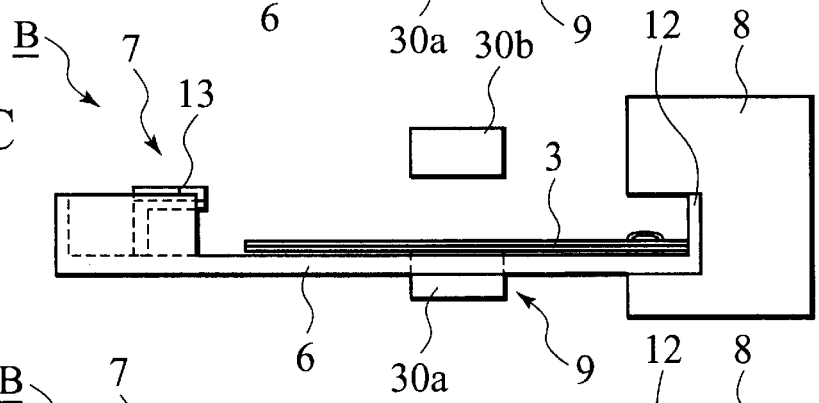
Figure 15D:
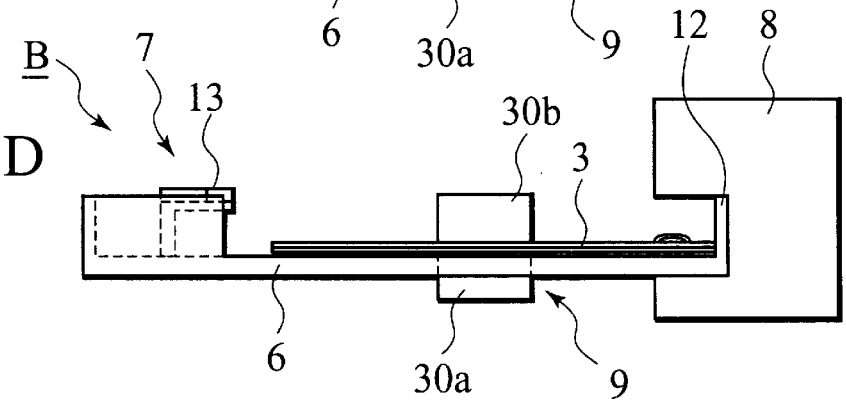

After the stapling operation of the stapler 8 is finished, as shown in FIG. 15C, it is released that both of the paper jogging unit 7 and the upper driven roller 30*b* press the collated sheet 3 to the paper-side reference wall 12 and the paper jogging tray 6, respectively. As a result, the deflection of the collated sheet 3 is canceled and the discharging operation of the collated sheet 3 is carried out while any deflection is being removed therefrom. Thus, since the collated sheet 3 is not fed obliquely, the feeding state is stabilized to produce no paper-jam. As mentioned above, even if the paper size of the collated sheet 3 is somewhat larger than the standard size, the stability in stapling position and the stability in discharging the papers can be ensured.

We investigated the occurrence frequency of paper-jam in both cases of performing and non-performing the nip-releasing operation before discharging the collated sheet 3. As shown in FIG. 6, the result resides in that the paper-jam can be canceled by the nip-releasing operation certainly.

In the above-mentioned embodiment, the nip-releasing period after stapling the collated sheet 3 by the stapler 8 may be adjustable. That is, a time required to cancel the deflection of the collated sheet 3 depends on the character of papers forming the collated sheet 3. If the nip-releasing period is changeable corresponding to the paper character of papers, then it becomes possible to transfer the collated sheet 3 as fast as possible while maintaining the stability in transferring the sheet 3.

Although the stapler processing part B of the above-mentioned embodiment has the paper jogging tray 6 inclined to the horizontal direction, the paper jogging tray 6 may be arranged in the horizontal direction alternatively. However, since the inclination of the paper jogging tray 6 allows the collated sheet 3 to be transferred by its slipping on the tray 6 in the above embodiment, the arrangement dispenses with means for loading the collated sheet 3 to the paper jogging tray 6.

According to the embodiment of the invention, since the presser jogging member 13 is constructed so as to press only the side face of the collated sheet 3 and further reciprocate on the paper jogging tray 6 in an oblique direction toward the intersection of the paper-side reference wall 12 with the paper-tip reference wall 11, it is possible to simplify the paper jogging unit 7. Additionally, the movement of the presser jogging member 13 allows the collated sheet 3 to be pressed to the paper-side reference wall 12 and additionally, an external force to urge the collated sheet 3 to the paper-side reference wall 12 is produced by a frictional force between the member 13 and the collated sheet 3. Therefore, it is possible to accomplish further stabilized jogging for papers.

Since the discharge tray C is arranged on the same side of the collating body A as the paper feed trays 2*a* to 2*j*, the arrangement allows a user to perform not only visual-checking of the paper feed trays 2*a* to 2*j* and the discharge tray C in the same position about the collating machine 1, but also the resupply action of papers and the pick-up action of the collated sheets 3, thereby facilitating handling of the collating machine 1.

Further, owing to the provision of the presser jogging member 13 with the upper face part 13*a*, it is possible to prevent the collated sheet 3 from surmounting the member 13 due to its movement from the stand-by position to the paper jogging position.

Although the stapler processing apparatus of the invention is embodied by the stapler processing part B of the collating machine 1 in the above-mentioned embodiment, of course, the same part B may be installed in or connected with another element except the collating machine 1 in the modification.

Figure 17:
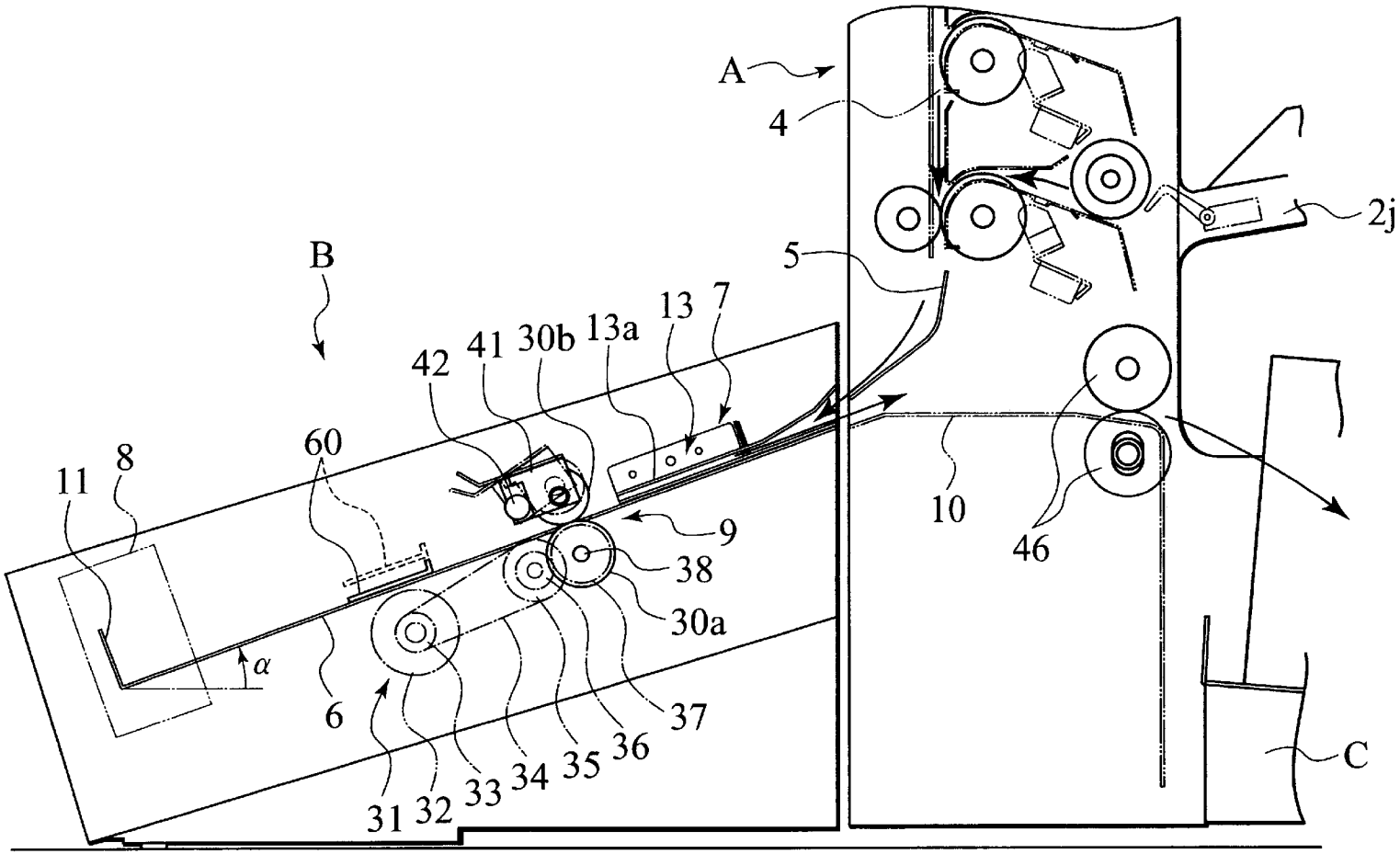
FIG. 17 is an enlarged view of an essential part of a paper collating machine in accordance with another embodiment of the present invention.

FIG. 17 shows the essential part of a collating machine equipped with the stapler processing apparatus in accordance with another embodiment of the present invention. Also in this embodiment, a stapler processing part (stapler processing apparatus) B is arranged behind a collating body A and on its lower side. The stapler processing apparatus B includes a paper jogging tray 6 into which a collated sheet (not shown) is to be loaded, a paper jogging unit (paper jogging means) 7 for jogging the collated sheet by pressing it on the paper jogging tray 6 by a presser jogging member 13, a stapler 8 for stapling the collated sheet jogged by the paper jogging unit 7, a paper presser plate (paper pressing means) 60 for nipping the collated sheet stapled by the stapler 8, and a paper discharging unit (paper discharging means) 9 for discharging the collated sheet from the paper jogging tray 6 by acting a transfer force due to the rotations of an upper driven roller 30*b* and a lower drive roller 30*a*.

In operation, when stapling the collated sheet by the stapler 8, the paper presser plate 60 is brought into close contact with the paper jogging tray 6 thereby forcing the collated sheet to the tray 6. After completing the stapling operation, the paper jogging operation of the paper jogging unit 7 is stopped and further, the paper presser plate 60 is separated from the paper jogging tray 6 to release the collated sheet from being nipped, temporarily. Thereafter, the paper presser plate 60 is brought into close contact with the paper jogging tray 6 again and then, the discharging operation is started.

Again noted that if the paper size of the collated sheet is somewhat larger than the standard size, the paper jogging unit 7 will jog the collated sheet in the deflected condition where the intermediate portion of the collated sheet is raised. However, the deflection of the collated sheet is suppressed by the paper presser plate 60 pressing it down. Then, the stapler 8 staples the collated sheet 3 while the deflection is being suppressed. After the stapling operation of the stapler 8, the paper jogging unit 7 is released from pressing the collated sheet and further, the paper presser plate 60 is also released from pressing the collated sheet to the paper jogging tray 6. As a result, the deflection of the collated sheet 3 is canceled and the discharging operation of the collated sheet 3 is carried out while any deflection is being removed therefrom. Accordingly, even if the paper size of the collated sheet is somewhat larger than the standard size, the stability in stapling position and the stability in discharging the papers can be ensured, as similar to the previous embodiment.

Noted that, in common with the afore-mentioned embodiments, the shown collating machine has a single transfer route where one collated sheet is transferred from the collating body A to the stapler processing part B via the first transfer path 5 and thereafter, the collated sheet is transferred from the stapler processing part B to the discharging part C via the second transfer path 10. In the modification, the collating machine may include an additional transfer route to transfer one collated sheet from the collating body A to the discharging part C without the intermediary of the stapler processing part B, allowing the transfer route to be selected from these routes optionally.

Finally, it will be understood by those skilled in the art that the foregoing description are preferred embodiments of the disclosed stapler processing apparatus and method. Various changes and modifications may be made to the present invention without departing from the spirit and scope of the invention.

What is claimed is:

1. A stapler processing apparatus comprising:

a paper jogging tray into which a plurality of papers are to be loaded;

paper jogging means for jogging the papers by forcing respective end faces of the papers to a reference wall of the paper jogging tray;

a stapler for stapling the papers jogged by the paper jogging means;

paper pressing means for nipping the papers stapled by the stapler;

paper discharging means for discharging the papers from the paper jogging tray by acting a transfer force due to the rotations of an upper and lower rollers on the papers; and control means for controlling the operations of the paper jogging means, the stapler, the paper pressing means and the paper discharging means in such a manner that:

at stapling the papers by the stapler, the control means makes the paper pressing means in close contact with the paper jogging tray thereby pressing the stapled papers to the paper jogging tray;

after completing the stapling operation of the stapler, the control means makes the paper jogging means to stop a paper jogging operation thereof and the paper pressing means to separate from the paper jogging tray thereby once releasing the papers from the paper pressing means; and subsequently, the control means makes the paper pressing means in close contact with the paper jogging tray and also makes the paper discharging means start discharging the stapled papers.

2. A stapler processing apparatus comprising:

a paper jogging tray into which a plurality of papers are to be loaded;

paper jogging means for jogging the papers by forcing respective end faces of the papers to a reference wall of the paper jogging tray;

a stapler for stapling the papers jogged by the paper jogging means;

a pair of upper and lower rollers for nipping the papers stapled by the stapler therebetween;

paper discharging means for discharging the stapled papers from the paper jogging tray by acting a transfer force due to the rotations of the upper and lower rollers on the papers; and control means for controlling the operations of the paper jogging means, the stapler, the upper and lower rollers and the paper discharging means in such a manner that:

at stapling the papers by the stapler, the control means makes the upper roller in close contact with the lower roller thereby pressing the stapled papers to the paper jogging tray;

after completing the stapling operation of the stapler, the control means makes the paper jogging means to stop a paper jogging operation thereof and the upper roller to separate from the lower roller thereby once releasing the papers from the upper and lower rollers; and subsequently, the control means makes the upper roller in close contact with the lower roller and also makes the paper discharging means start discharging the stapled papers.

3. A stapler processing apparatus as claimed in claim 1, wherein a period of releasing the papers subsequent to the stapling operation of the stapler is adjustable.

4. A stapler processing apparatus as claimed in claim 2, wherein a period of releasing the papers subsequent to the stapling operation of the stapler is adjustable.

5. A stapler processing method comprising the steps of:

loading a plurality of papers to a paper jogging tray;

forcing respective end faces of the papers to a reference wall of the paper jogging tray thereby jogging the papers;

making an upper roller in close contact with a lower roller thereby pressing the jogged papers to the paper jogging tray;

stapling the pressed papers by means of a stapler;

after stapling the papers, stopping jogging the papers and further separating the lower roller from the lower roller thereby once releasing the papers from the upper and lower rollers; and subsequently, again making the upper roller in close contact with the lower roller and further discharging the stapled papers from the paper jogging tray.

* * * * *